US007293911B2

(12) United States Patent
Bonvin et al.

(10) Patent No.: US 7,293,911 B2
(45) Date of Patent: Nov. 13, 2007

(54) TIMEKEEPER WITH A MECHANISM FOR MEASURING SETTABLE PREDETERMINED PERIODS

(75) Inventors: Nicolas Bonvin, Vernier (CH); Adrien Frederic Farron, Neuchatel (CH); Denis Rudaz, Prevessin-Moens (FR)

(73) Assignee: Rolex S.A., Geneva (CH)

( * ) Notice: Subject to any disclaimer, the term of this patent is extended or adjusted under 35 U.S.C. 154(b) by 0 days.

(21) Appl. No.: 11/538,516

(22) Filed: Oct. 4, 2006

(65) Prior Publication Data

US 2007/0091727 A1 Apr. 26, 2007

(30) Foreign Application Priority Data

Oct. 21, 2005 (EP) ..... 05405596

(51) Int. Cl.
*G04F 1/00* (2006.01)
*G04F 3/00* (2006.01)
*G04F 8/00* (2006.01)

(52) U.S. Cl. ..... 368/97; 368/106; 368/108

(58) Field of Classification Search ..... 368/97–102, 368/106, 107–109
See application file for complete search history.

(56) References Cited

U.S. PATENT DOCUMENTS 1,790,359 A * 1/1931 Weir ..... 368/101
2,300,950 A * 11/1942 Lux ..... 368/76
2,783,835 A * 3/1957 Poole ..... 368/108
3,077,729 A * 2/1963 Schlenker ..... 368/228
3,747,324 A * 7/1973 Foufounis ..... 368/228
5,077,708 A 12/1991 Schneider
7,130,247 B2 * 10/2006 Brida et al. ..... 368/110

FOREIGN PATENT DOCUMENTS

| | | |
|---|---|---|
| CH | 175961 | 8/1964 |
| CH | 548061 | 4/1974 |
| CH | 692523 | 7/2002 |
| FR | 1502690 | 11/1967 |
| WO | WO 02/077725 | 10/2002 |

* cited by examiner

*Primary Examiner*—Vit W Miska
(74) *Attorney, Agent, or Firm*—Sturm & Fix LLP

(57) ABSTRACT

This timekeeper comprises a first timer (4), means (12) for connecting it selectively to the train of the timekeeper (T), a second timer (5), a synchronous coupling between the first (4) and second (5) timers, and fly-back means (13, 13', 9, 11) for said timers (4, 5). An auxiliary motive source (10') is in a driving relationship with the second timer (5) and a one-way coupling (6*a*, 7*a*) is situated between the first (4) and second (5) timers to regulate the speed of movement of the latter at a predetermined ratio with the speed of movement of the first timer (4) while allowing one-way relative movement of the first timer (4) relative to the second (5) when the latter is in the stop position and one-way relative movement in the opposite sense of the second timer (5) when the first timer (4) is in the stop position.

20 Claims, 6 Drawing Sheets

TIMEKEEPER WITH A MECHANISM FOR MEASURING SETTABLE PREDETERMINED PERIODS

CROSS REFERENCE TO RELATED APPLICATIONS

This application claims priority of European Application No. 05405596.7 filed Oct. 21, 2005, which is incorporated by reference herein in its entirety.

BACKGROUND OF THE INVENTION

1. Field of the Invention

The present invention relates to a timekeeper with a mechanism for measuring settable predetermined periods, comprising a first timer, means for connecting it selectively to the train of the timekeeper, a second timer, a synchronous coupling between the first and second timers, and fly-back means for said timers.

2. Description of the Related Art

Timers of this kind are used particularly for controlling the starts of regattas where the competitors are warned a few minutes in advance of the start time by a gun. A second gun is also fired halfway through the period between the first gun and the third gun which will give the start. This second gun gives competitors the chance to check whether they are synchronized with the official time. This period is usually ten or six minutes so the second gun is fired at exactly the halfway mark, at five or three minutes, respectively.

A timer of this kind has already been proposed in CH 692 523. It has apertures in the dial and a disk having sectors of different colors which appear under the apertures and move as the period is measured. Such a device gives no indication of seconds and cannot be corrected if the timer was not started at the right instant, nor can the countdown time be programmed.

Another proposal, given in WO 02/077725, is a chronograph mechanism capable of operating either in the conventional direct sense, or in the retrograde sense for a countdown. Such a mechanism does not however offer a way of resetting the timer, specifically at the second gun fired before the start of a regatta. In the event of a false start it offers no way of storing the previously programmed period, and after each measurement of a predetermined period has to be reset for the next period to be measured, even if the latter is identical to the previous period.

What is more, with this timer, at the end of the measured predetermined period, the minutes timer does not stop at zero but continues its retrograde movement until stopped.

As can be seen, the systems proposed hitherto all have a number of drawbacks.

BRIEF SUMMARY OF THE INVENTION

It is an object of the present invention at least partly to remedy these drawbacks.

To this end, the subject of the present invention is a timekeeper with a mechanism for measuring a settable predetermined period as claimed in claim 1.

By virtue of its design, the timekeeper according to the invention allows the measured period to be programmed and the programmed period to be stored at each fly-back as long as this program has not been modified. The timing mechanism can be resynchronized by a user action, from an external time base at any time during the measurement of the predetermined period. This facility is important because it means that any error made when starting to measure the predetermined period can be corrected, whether to correct a delay or an anticipation. This resynchronizing facility has the advantage that the timer can be resynchronized exactly on the second gun preceding the start of a regatta.

Advantageously, the second timer, which is preferably the minutes timer, is stopped at the end of the measured predetermined period, while the first timer, which is preferably the seconds timer, continues moving until stopped. This makes it possible for example to measure how much time has passed since the start of the regatta.

Other features and advantages will become apparent in the course of the following description of two embodiments of the timekeeper illustrated schematically and by way of example in the attached drawings.

DETAILED DESCRIPTION OF THE INVENTION

Upon examination, the second embodiment will be seen to be relatively complex since its mechanism is divided between the two sides of the timekeeper. It was therefore felt advisable to begin by describing the invention with the aid of a simplified version which will facilitate an understanding of the inventive concept.

Figure 1:
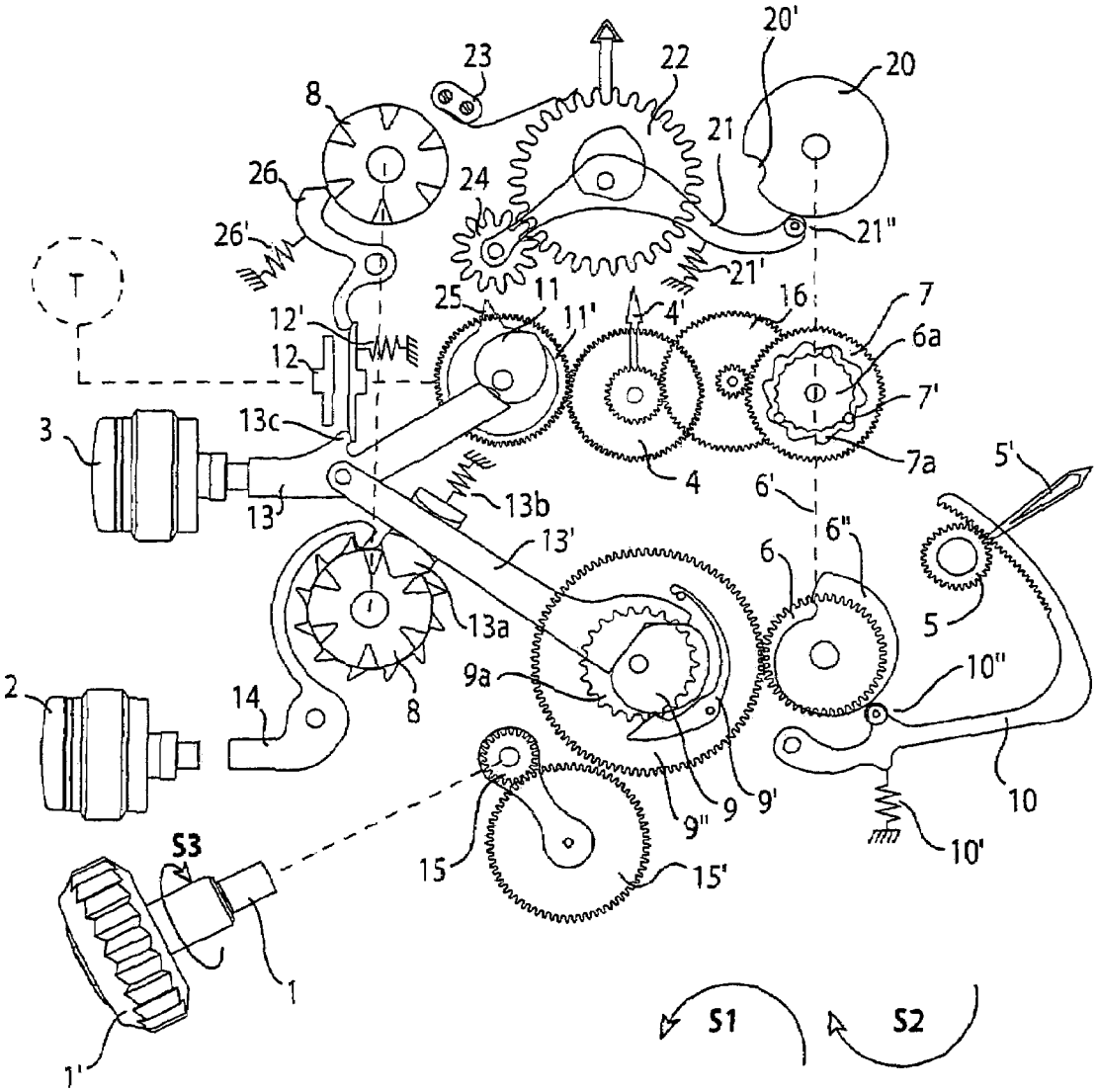
FIG. 1 is a plan view of an embodiment designed to illustrate the principle of the invention.
Figure 2:
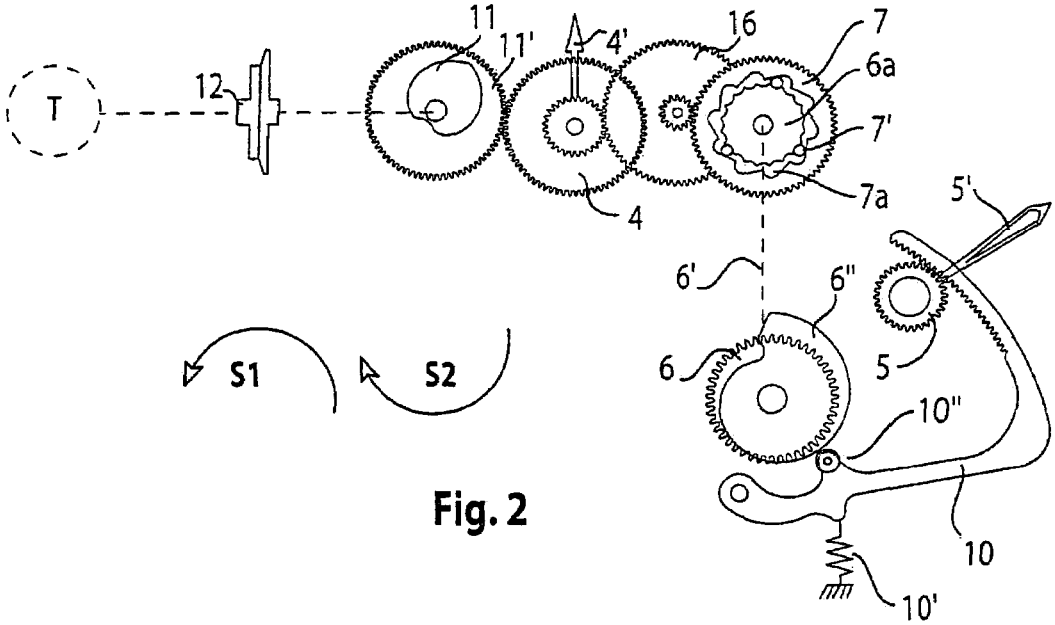
FIG. 2 is a partial view of FIG. 1 illustrating the timing device in operation.

The mechanism shown in FIG. 1 comprises a control stem 1 fixed to an actuating crown 1' which rotates, much like a winding stem, and two pushers 2 and 3. The pusher 2 is able to engage with the ratchet teeth of a column wheel 8 through an intermediate click lever 14 and is used to start and stop the timer mechanism. The pusher 3 is for resetting and resynchronizing the wheels and pinions of the timers 4 and 5 on which the seconds hand 4' and minutes hand 5' are mounted, respectively. The action of the pusher 3 is transmitted to two fly-back cams 11, 9 by two fly-back levers 13, 13', respectively. The lever 13' is pivoted to the lever 13 and is in engagement with a sliding member 13*a* pressed against the column wheel 8 by a spring 13*b*, for a purpose which will be explained later. It should be observed that the fly-back cam 9 must be shaped in such a way that the pressure exerted by the lever 13' during resetting always causes it to turn in the sense S1 for a reason which will be explained later.

The wheel and pinion 4 of the first or seconds timer 4' meshes on the one hand with a wheel and pinion 11' fixed to the fly-back cam 11 and on the other hand with a wheel and pinion 16 whose pinion meshes with a wheel 7 mounted freely on the arbor 6' of a wheel 6 and of a snail cam 6" which are both fixed to this arbor 6', which is in turn fixed to a one-way coupling element 6*a* concentric with a one-way coupling element 7*a* fixed to the wheel 7. Balls 7' are arranged between these one-way coupling elements 6*a*, 7*a* which are so shaped that, in the rotational sense S1 of the arbor 6' and of the one-way coupling element 6*a*, this arbor 6' is coupled in rotation to the wheel 7. On the other hand, when the wheel 7 turns in the sense S2, it is the wheel 7 which drives the arbor 6'. The utility of this one-way drive will be explained later. When the arbor 6' and the one-way coupling element 6*a* are turning in the sense of rotation S2, they are uncoupled from the wheel 7, and the latter can turn freely in the sense S1 relative to the arbor 6'.

The wheel and pinion 5 of the second or minutes counter, which is a hand 5' and a graduation (not shown), is in engagement with the toothed sector of a rack lever 10 pressed against the snail cam 6" by a spring 10', via a roller 10" that transmits the pressure of the spring 10' to this snail cam 64", creating a torque tending to turn both it and the wheel 6 which is also fixed to the arbor 6', in the sense S1. This wheel 6 meshes with a setting wheel 9" that is connected to the fly-back cam 9 fixed to a star wheel 9*a* positioned by a click 9', allowing the angular position of the setting wheel 9" to be modified relative to that of the fly-back cam 9, in increments of one step of the star wheel 9*a*, when the latter is immobilized by the lever 13'. For this purpose, this setting wheel 9" meshes with a connecting wheel 15 through an intermediate reverser pinion 15' which is pivoted freely on a rocker and makes it possible to transmit the rotation of the connecting wheel 15 to the wheel 9" only when this reverser pinion 15' is turning in the sense S2. This rotation is controlled by the hand-controlled stem 1 through a pinion (not shown) coaxial with and fixed to this stem 1 and having end-on teeth like those of a clutch pinion. The pitch of the teeth of the star wheel 9*a* for setting the period to be measured corresponds preferably to one minute of the minutes timer 5.

Angular movement of this setting wheel 9" in the sense S1 relative to the fly-back cam 9 is transmitted to the snail cam 6" which turns in the sense S2 and transmits this movement to the hand 5' of the minutes timer 5 which is driven in the sense S2 by the rack lever 10 which, when raised by the snail cam 6", turns in the sense S1. It should be observed that this setting can only be done by turning the wheels and pinions of the setting mechanism of the minutes timer 5 in the sense indicated above, because of the one-way drive device between the wheels 6 and 7. This is due to the fact that, since the actions of the two levers 13, 13' are simultaneous, the train of the first or seconds timer 4 is immobilized, so that the wheel 7 is also immobilized, allowing the one-way coupling element 6*a* fixed to the wheel 6 and snail cam 6" to move only in the sense S2.

For the same reason, the minutes timer 5 can only be made to fly back by turning the snail cam 6" in the sense S2. To achieve this objective, the setting wheel 9" has a larger diameter than the wheel 6, in order to optimize, in energy terms, the design of the fly-back cam 9.

The selective connection between the timer mechanism and the train (not shown) of the timekeeper T which is used to drive this timer is made possible by a known type of clutch device 12 formed by two axially mobile circular elements and a spring 12' that tends constantly to get them to bite together. This clutch device is controlled partly by a lever 26 applied by a spring 26' against the columns of the column wheel 8 and partly by a protrusion 13*c* on the lever 13. The lever 26 and the protrusion 13*c* both act against the force of the clutch spring 12' to separate the circular elements of the clutch 12 from each other.

Although the essential object of the timer mechanism according to the invention is to time predetermined settable periods, particularly for measuring the time running up to the start of an event, more particularly the start of a regatta, it is perfectly possible for this mechanism to continue measuring time after the start of the regatta.

For this purpose, the wheel 11' connected selectively to the train of the timekeeper T by the clutch 12 is fixed to a disk having a drive protrusion 25. In addition, the arbor 6' fixed to the wheel 6 and to the snail cam 6" is fixed to a disk 20 containing a recess 20' whose angular position is adjusted to coincide with the stop position of the second timer 5. One end 21" of a lever 21 is pushed by a spring 21' against the edge of the disk 20. This lever 21 pivots on the arbor of a wheel 22 of an auxiliary minutes timer and carries a pinion 24 meshing with the wheel 22. A jumper 23 serves to position this wheel 22. When the recess 20' of the disk 20 arrives in front of the end 21" of the lever 21, the latter pivots in the sense S1, allowing the protrusion on the disk 25 to drive the pinion 24 and the wheel 22 of the minutes timer one step in every revolution, i.e. every 60 seconds, given that the wheel 11' has a ratio of 1:1 with the wheel 4 of the seconds timer.

Figure 8:
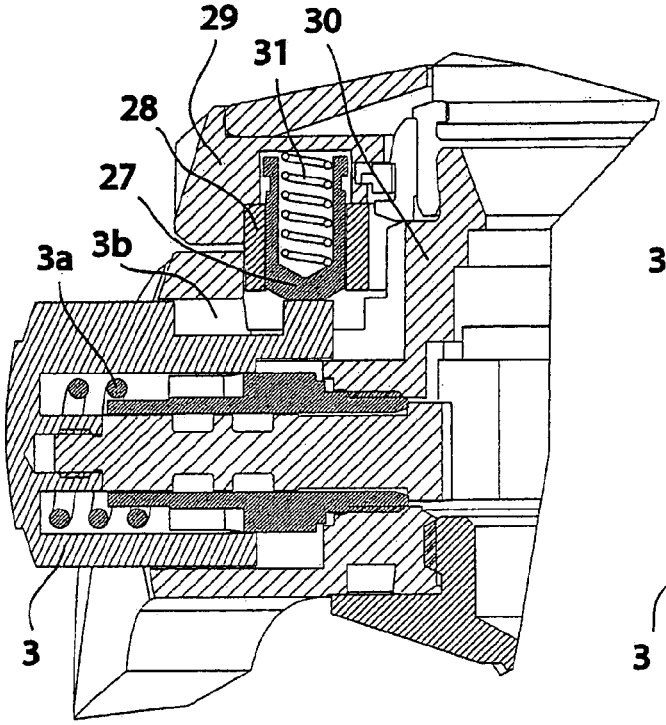
FIG. 8 is a partial cross section, perpendicular to the plane of the movement, through the timekeeper case, passing through the axis of the resetting and resynchronizing pusher, at rest.
Figure 9:
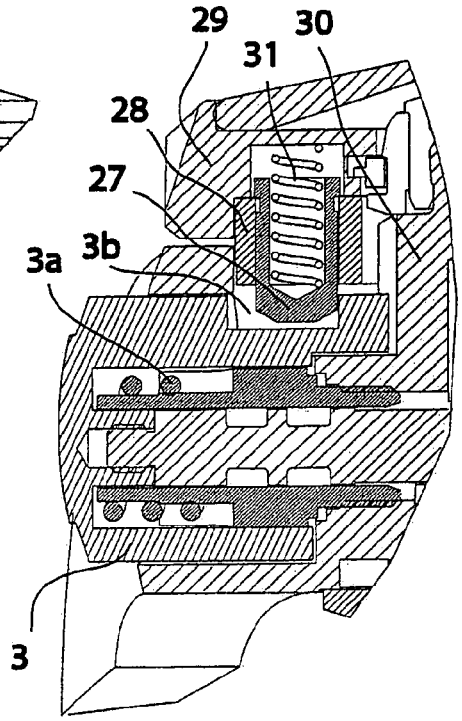
FIG. 9 is a view similar to FIG. 8 showing the resetting and resynchronizing pusher in the active position.

During programming, the timer mechanism described above requires that the pusher 3 be kept depressed as will be seen later. Advantageously, in order to avoid having to use both hands simultaneously which would mean having to remove the watch from one's wrist, a device for temporarily locking the pusher 3 is provided. This device is illustrated in FIGS. 8 and 9. As can be seen in these figures, the pusher 3 is held normally in the position illustrated in FIG. 8 by a spring 3*a*. It will also be seen that a piston 27 slides inside a ring 28 attached to a rotating bezel 29 of known type mounted on the watch middle 30. This piston 27 is pressed against the pusher 3 by a spring 31. The pusher 3 has a gap 3*b*, so that when it is pushed towards the interior of the case and the rotating bezel 29 has first been moved into the angular position illustrated in FIGS. 8 and 9 where the axis of the piston 27 intersects the axis of the pusher 3, the piston 27 is pushed into the gap 3*b* by the spring 31. To remove it, the bezel 29 is simply returned to its initial angular piston, whereupon the piston 27 releases the pusher 3.

Figure 10:
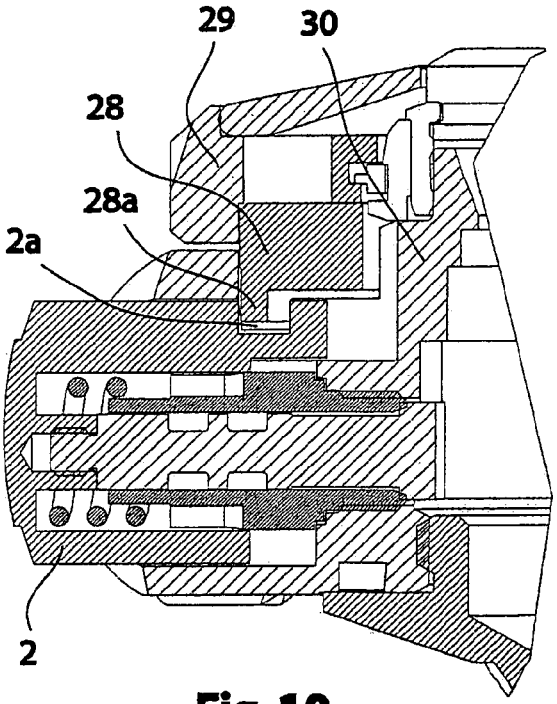
FIG. 10 is a view similar to FIG. 8 but with the cross section passing this time through the axis of the start/stop pusher.

When the bezel 29 is in the angular position shown in FIG. 10, allowing the pusher 3 to be locked, it simultaneously allows the pusher 2 to be disabled, which saves the user from pressing the wrong pusher and starting the timer instead of setting the period he or she wishes to measure. For this purpose the ring 28 fixed to the rotating bezel 27 has a semi-annular projection 28*a* which, when the rotating bezel 27 is turned to lock the pusher 3 in the depressed position, enters a gap 2*a* in the pusher 2, preventing it from being actuated.

As will have been seen in the course of the above description, because the measuring mechanism measures a settable predetermined time period, the minutes hand indicates the total period to be measured and, once started, at all times therefore indicates how much time is remaining to the end of the measured period.

Operating the mechanism described above involves a number of steps, namely: setting the period to be measured, starting the mechanism, resetting or resynchronizing during operation, stopping the mechanism, and causing the timers 4 and 5 to fly back.

In order to set the period to be measured, the user must first turn the rotating bezel 29 of the case to the position shown in FIGS. 8, 9 and 10, in which the start/stop control pusher 2 is disabled. He then depresses the resetting and resynchronizing pusher 3 to get it into the position shown in FIGS. 1 and 10, in which it is retained by the piston 27 and in which the levers 13 and 13' prevent the fly-back cams 11 and 9 from turning. He must then rotate the control stem 1 by means of the crown 1' in the sense S3 to bring about a relative movement of the setting wheel 9" in the sense S1 relative to the fly-back cam 9. Since, as explained above, the period can only be set by turning the snail cam 6" in the sense S2, then if it is wished to reduce the period to be measured from 10 to 6 minutes, for example, assuming 10 minutes to be the maximum settable predetermined period, the roller 10" of the rack lever 10 must be moved from 10 minutes to 0 minutes and then incremented until the hand 5' is pointing at the division corresponding to 6 minutes. The reverse is not possible because of the snail shape of the cam 6" and because the one-way drive wheel 7 is locked by the lever 13 engaging with the fly-back cam 11 fixed to the wheel 11' in a positively controlled relationship with the wheel 7, which does not allow the one-way coupling element 6*a* fixed to the snail cam 6" and to the wheel 6 to rotate in any sense except the sense S2.

The timer having thus been set, it is started by returning the rotating bezel 29 of the case to its inactive position. This has the effect of releasing the pushers 2 and 3 and the fly-back cams 9 and 11. The pusher 2 is depressed, which turns the column wheel 8 one step through the click lever 14. The column wheel 8 releases the lever 26 which allows the clutch device 12 to connect the train of the timer to that of the timekeeper T. The freewheel 7 synchronizes the timer 5 under the force of the spring 10' with the speed of rotation of the train of the timer in a kinematic coupling with the timekeeper train. For its part, the force exerted by the spring 10' on the wheel 6 and on the one-way coupling element 6*a* simultaneously keeps the timer train under tension and prevents floating of the hands resulting from the clearance of a gear that is not under tension. Moreover, the force necessary to tension this spring 10' is not taken from the barrel spring of the timekeeper: instead, this spring is tensioned by hand every time the timers 4, 5 are caused to fly back.

Consequently the mechanism which measures the predetermined period is driven by the relaxing of the spring 10' which returns the stored energy without using the energy of the barrel spring of the timekeeper.

In the countdown to the start of a regatta, the first gun is usually fired 10 minutes and in some cases 6 minutes before the start and the second gun is fired halfway through the countdown, i.e. at 5 minutes or 3 minutes, respectively, before the third gun which indicates the start. It is often difficult to start the timer exactly on the first gun because the user does not know exactly when it will be fired. However, the competitor can much more easily anticipate the moment when the second gun is to be fired because he knows that it is five minutes, or three minutes, respectively, after the first gun. At this time he can read the difference between the start of his timer and the second gun to work out how many seconds before or after the gun he started his timer.

Figure 4:
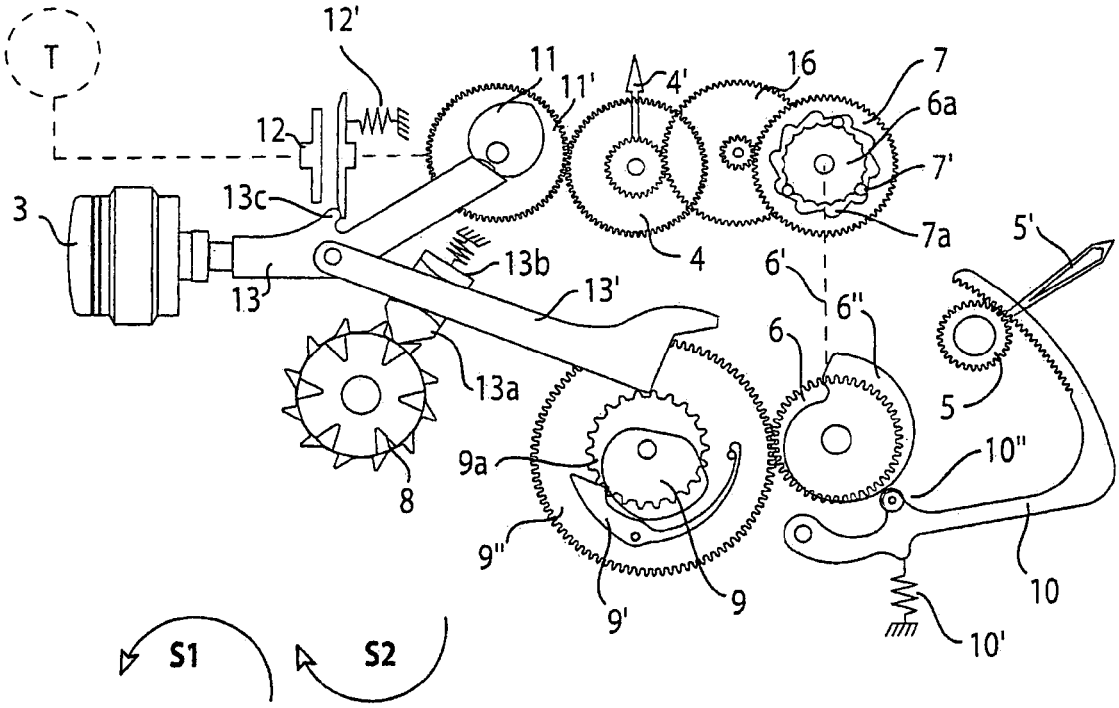
FIG. 4 is a view similar to FIG. 1 in another phase of operation.

The measuring mechanism of the timekeeper according to the present invention solves this problem by making it possible to resynchronize the timer while measuring. This new function is explained with reference to FIG. 4. When the timer is started, the column wheel 8 rises and disables the lever 13' as illustrated in this FIG. 4. When the pusher 3 is depressed, the lever 13 causes the hand 4' of the first or seconds timer to fly back, causing the hand 5' of the second or minutes timer to return to the nearest whole minute. As long as the pusher 3 is kept depressed, the countdown is put on hold, and starts again when the pusher 3 is released. This means that the pusher can be depressed a matter of tens of seconds before the second gun and released at the precise instant the second gun goes off. In the example illustrated, with a symmetrical heart-shaped cam 11, the instant when the pusher 3 is actuated should not however be more than 30 seconds before the minutes timer 5 arrives at the whole minute at which the second gun is due to be fired, otherwise it will be returned to the minute preceding that at which the second gun is due, with the result that, when the pusher 3 is released on the gun, the minutes timer 5 would be one minute behind. The user can also briefly depress the pusher 3 at the precise instant of the second gun. Since the lever 13' is disabled, only the lever 13 strikes the cam 11 fixed to the wheel 11'. At the same time, the protrusion 13*c* opens the clutch device 12 and thus allows the seconds timer 4 to be reset. The user releases the pressure on the pusher 3 to allow the timers 4, 5 to resume their countdown.

If the fly-back of the seconds timer 4 involves a virtually instantaneous movement of the wheel 11' in the sense S2, the wheel 7 is moved virtually instantaneously in the sense S1 through an angle proportional to the gear ratio. Because of the one-way coupling between the wheel 7 and the wheel 6 and because of the torque exerted on the wheel 6 in the sense S1 by the spring 10', the wheel 6 follows the virtually instantaneous movement of the wheel 7 and thus corrects the position of the minutes hand 5'. If the seconds counter is corrected by a virtually instantaneous movement of the wheel 11' in the sense S1, the wheel 7 is moved in the sense S2, i.e. it reverses compared with its normal direction of movement. Because of the one-way drive between this wheel 7 and the wheel 6, the wheel 6 is also driven in the sense S2 against the torque exerted by the spring 10' so that the rack lever 10 is caused to rise around the cam 6" and turn the minutes hand 5' in the sense S2.

Figure 3:
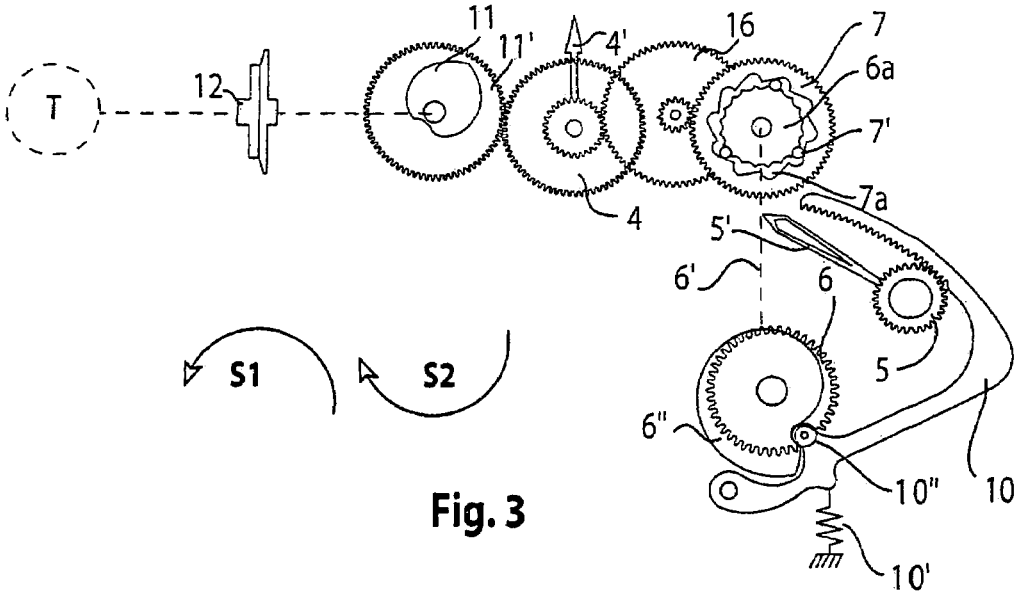
FIG. 3 is a view similar to FIG. 2 at the end of the measured period.

When the minutes hand 5' reaches the end of the measured period, the roller 10" of the rack lever 10 is stopped by the radial face of the snail cam 6", as FIG. 3 shows; but the seconds hand 4' can continue its normal course because of the one-way coupling between the wheels 6 and 7. At the precise instant at which the snail cam 6" stops, the end 21" of the lever 21 drops into the recess 20' of the disk 20, engaging the connecting wheel 24 with the drive protrusion 25 fixed to the wheel 11', allowing the auxiliary minutes timer 22 and the seconds timer 4 to measure the time that elapses after the end of the selected predetermined period, which was measured by the first or minutes timer 5.

The timer is stopped by pushing the start/stop pusher 2 which turns the column wheel 8, opens the clutch device 12, and stops the timers 4 and 22. The timers 4, 5 and 22 are made to fly back by means of the pusher 3 and levers 13, 13'. The fly-back lever for the auxiliary minutes timer 22 has not been shown, but consists of a third arm connected to the other two fly-back levers. It should be pointed out that the selected period to be measured is retrieved automatically by fly-back. If this period is to be changed, the user simply performs the corresponding operation mentioned above.

Figure 5:
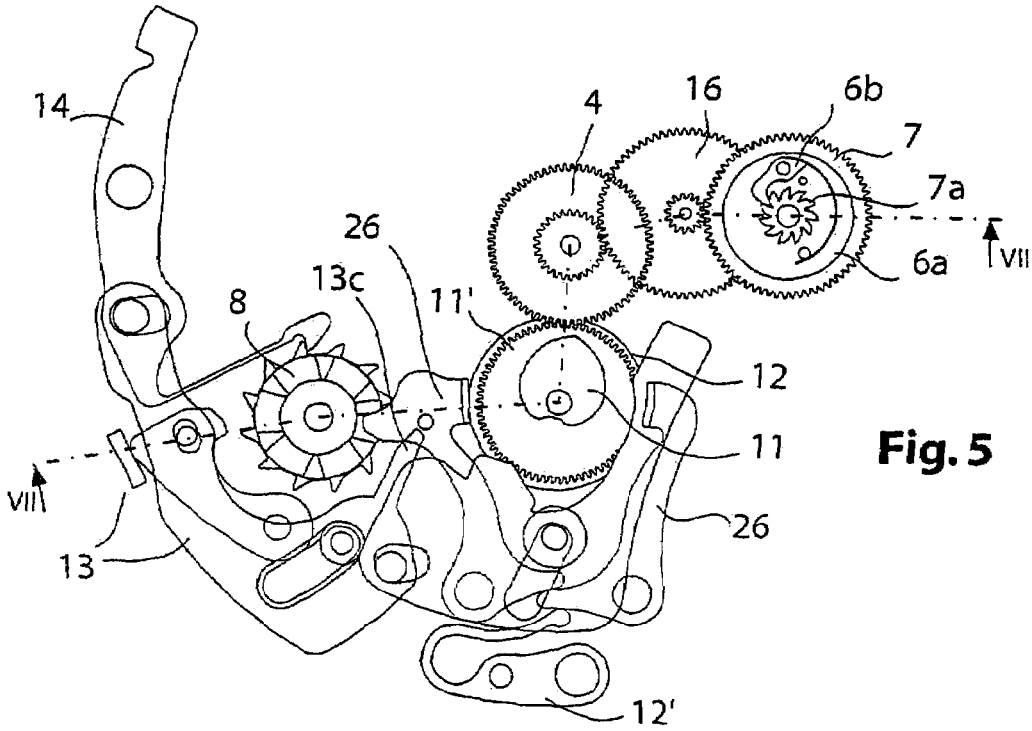
FIG. 5 is a plan view of one side of the timekeeper showing part of a second embodiment of the measuring mechanism of the timekeeper of the invention.
Figure 6:
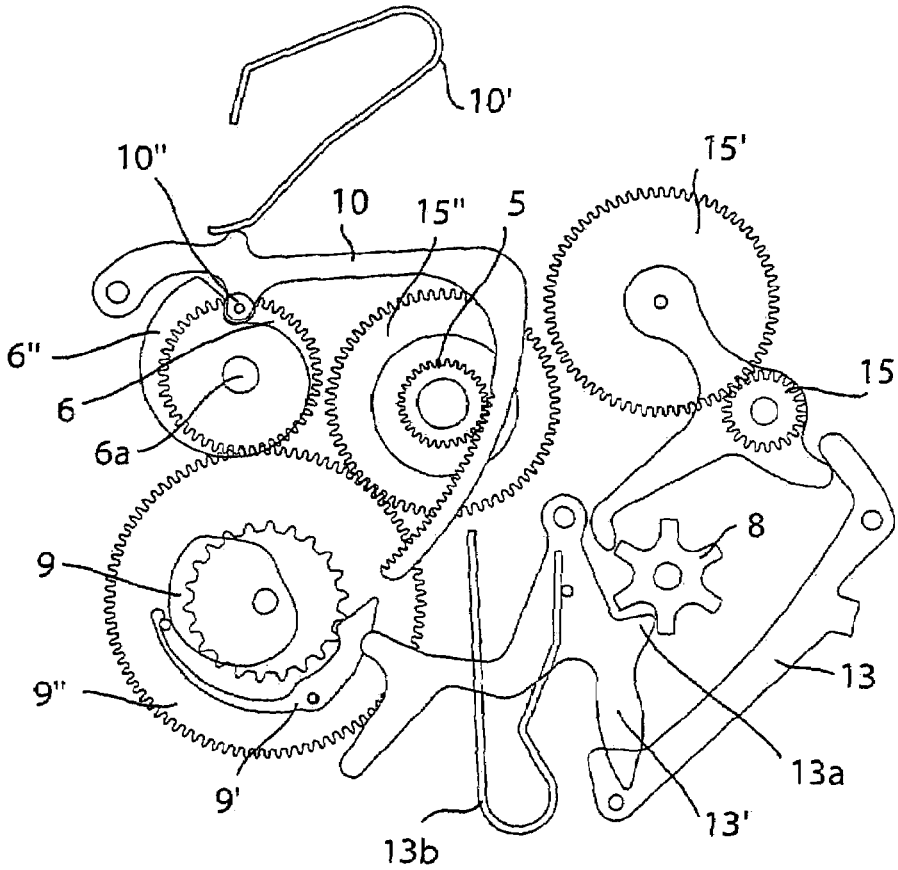
FIG. 6 is a plan view of the other side of the timekeeper showing the other part of this second embodiment.
Figure 7:
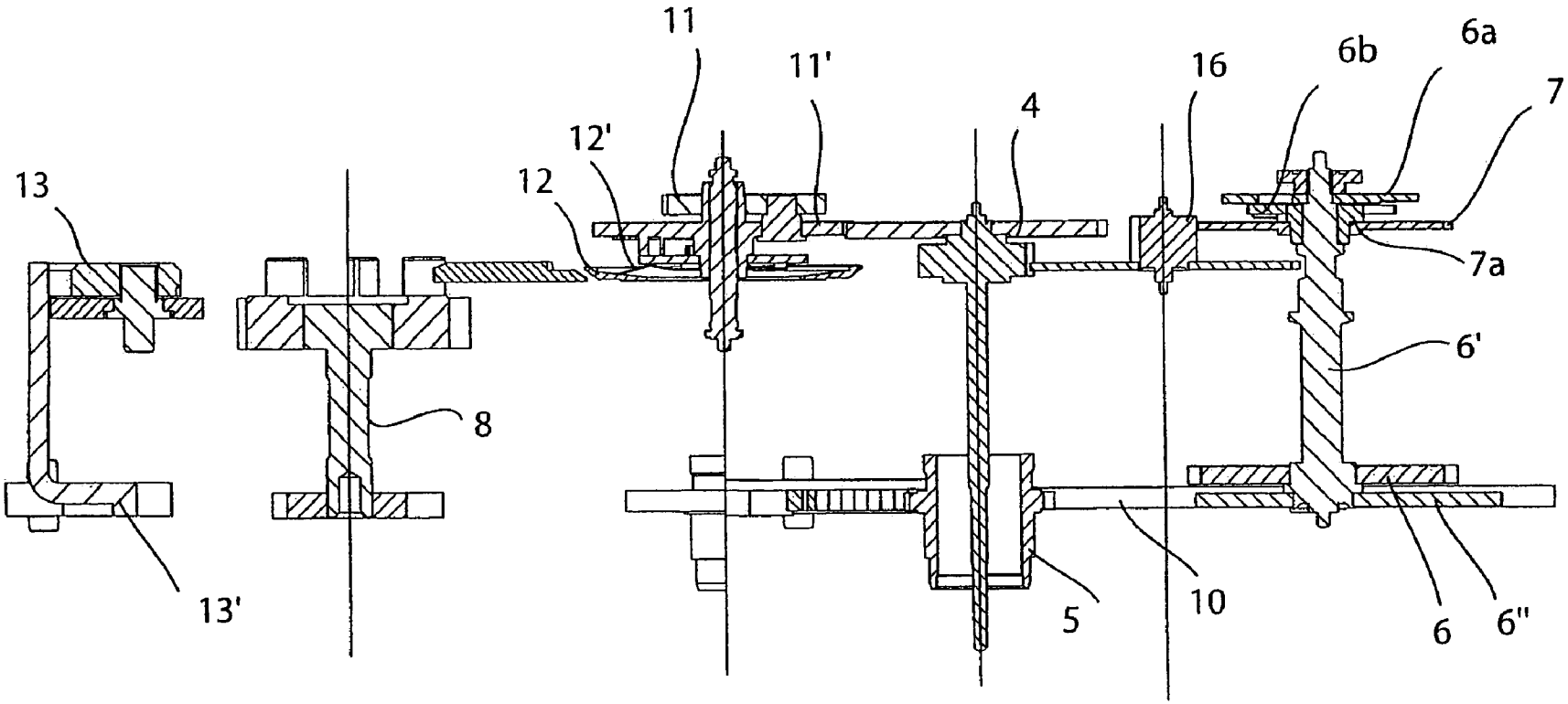
FIG. 7 is a cross section taken on VII-VII as marked in FIG. 5.

The embodiment shown in FIGS. 5-7 is a practical realization of the principle illustrated in FIGS. 1-4. To simplify the reading, all parts in this embodiment (FIGS. 5-7) that have the same functions as in the previous embodiment have the same reference symbols. Notice that this second embodiment has no auxiliary minutes timer.

As can be seen in the cross section in FIG. 7, the mechanism for timing a selected period is designed so that its parts can be arranged on the bridge side and on the dial side, with the watch movement T between them.

Some parts, notably the clutch 12 and the wheels 11, 4, 16 and 7, are situated on the bridge side, while the rack lever 10, the wheel 6, the snail cam 6" and the pinion of the minutes timer 5 are situated on the dial side. The column wheel 8 and the levers 13, 13' are on both sides of the movement. The arbor 6' connecting the wheel 6 to the one-way coupling element 6*a* working with the wheel 7 also extends through the movement. It will also be seen that the arbor of the pinion of the seconds timer 4 is coaxial with the pinion of the minutes timer 5, which makes it possible to read the minutes and the seconds on the same dial.

The one-way coupling device between the wheels 6 and 7 of this embodiment differs from that of the first embodiment essentially in that it comprises a ratchet-toothed pinion 7*a* fixed to the wheel 7 and engaging with a click 6*b* pivoting on a disk 6*a* fixed to the arbor 6' and to the wheel 6. Although realized slightly differently from the first embodiment, the principle of the one-way coupling is identical.

The invention claimed is:

1. A timekeeper with a mechanism for measuring settable predetermined periods, comprising a first time, means for connecting it selectively to the train of the timekeeper, a second timer, a synchronous coupling between the first and second timers, and fly-back means for said timers, wherein an auxiliary motive source is in a driving relationship with the second timer and a one-way coupling is situated between the first and second timers to regulate the speed of movement of the latter at a predetermined ratio with the speed of movement of the first timer while allowing one-way relative movement of the first timer with respect to the second when the latter is in the stop position and one-way relative movement of the second timer in the opposite sense when the first timer is in the stop position.

2. The timekeeper as claimed in claim 1, in which said fly-back means of said timers serve simultaneously to retension said auxiliary motive source.

3. The timekeeper as claimed in claim 1, in which said auxiliary motive source is in a driving relationship with a part of limited amplitude of movement, a positively controlled relationship being provided between this part and the second timer, hand-driven means serving to modify the position of said part of limited amplitude of movement relative to a position defined by a stop belonging to said part of limited amplitude of movement as a function of the selected period to be measured.

4. The timekeeper as claimed in claim 1, in which the measuring mechanism comprises means for disabling the fly-back means of said second timer, to allow said first timer to be reset while said predetermined period is being measured and to move the second timer in proportion to the corrected error of said first timer and means for disconnecting the means for selectively connecting the first timer to the train of the timekeeper.

5. The timekeeper as claimed in claim 4, comprising locking means for keeping the fly-back means of the timers in engagement with the timers during actuation of the means for modifying the angular position of said second timer relative to the position defined by said stop belonging to said part of limited amplitude of movement.

6. The timekeeper as claimed in claim 1, in which the first timer is a seconds timer and the second timer is a minutes timer.

7. The timekeeper as claimed in claim 1, comprising means for starting a second minutes timer at the end of the predetermined measured period.

8. The timekeeper as claimed in claim 2, in which said auxiliary motive source is in a driving relationship with a part of limited amplitude of movement, a positively controlled relationship being provided between this part and the second timer, hand-driven means serving to modify the position of said part of limited amplitude of movement relative to a position defined by a stop belonging to said part of limited amplitude of movement as a function of the selected period to be measured.

9. The timekeeper as claimed in claim 2, in which the measuring mechanism comprises means for disabling the fly-back means of said second timer, to allow said first timer to be reset while said predetermined period is being measured and to move the second timer in proportion to the corrected error of said first timer and means for disconnecting the means for selectively connecting the first timer to the train of the timekeeper.

10. The timekeeper as claimed in claim 3, in which the measuring mechanism comprises means for disabling the fly-back means of said second timer, to allow said first timer to be reset while said predetermined period is being measured and to move the second timer in proportion to the corrected error of said first timer and means for disconnecting the means for selectively connecting the first timer to the train of the timekeeper.

11. The timekeeper as claimed in claim 2, in which the first timer is a seconds timer and the second timer is a minutes timer.

12. The timekeeper as claimed in claim 3, in which the first timer is a seconds timer and the second timer is a minutes timer.

13. The timekeeper as claimed in claim 4, in which the first timer is a seconds timer and the second timer is a minutes timer.

14. The timekeeper as claimed in claim 5, in which the first timer is a seconds timer and the second timer is a minutes timer.

15. The timekeeper as claimed in claim 2, comprising means for starting a second minutes timer at the end of the predetermined measured period.

16. The timekeeper as claimed in claim 3, comprising means for starting a second minutes timer at the end of the predetermined measured period.

17. The timekeeper as claimed in claim 4, comprising means for starting a second minutes timer at the end of the predetermined measured period.

18. The timekeeper as claimed in claim 5, comprising means for starting a second minutes timer at the end of the predetermined measured period.

19. The timekeeper as claimed in claim 6, comprising means for starting a second minutes timer at the end of the predetermined measured period.

20. The timekeeper as claimed in claim 7, comprising means for starting a second minutes timer at the end of the predetermined measured period.

* * * * *